United States Patent [19]

Hall

[11] 4,210,316

[45] Jul. 1, 1980

[54] DRILL STRING SHOCK ABSORBER WITH IMPROVED PIN TYPE TORQUE TRANSMISSION MEANS

[75] Inventor: James R. Hall, Huffman, Tex.

[73] Assignee: Hughes Tool Company, Houston, Tex.

[21] Appl. No.: 7,264

[22] Filed: Jan. 29, 1979

[51] Int. Cl.[2] ..... E21B 17/02

[52] U.S. Cl. ..... 267/125; 175/306

[58] Field of Search ..... 64/23; 175/306, 321; 267/125, 137

[56] References Cited

U.S. PATENT DOCUMENTS

| | | | |
|---|---|---|---|
| 3,834,472 | 9/1974 | Perkins | 267/125 X |
| 4,145,034 | 3/1979 | Dyer | 267/125 |

*Primary Examiner*—Duane A. Reger

*Attorney, Agent, or Firm*—Robert A. Felsman

[57] ABSTRACT

A shock absorbing apparatus for use in an earth boring drill string is disclosed herein. The shock absorber is of the type having a mandrel reciprocally mounted for rotation with a tubular body; a sealed chamber between the tubular body and the mandrel containing pressurized fluid for absorbing load and shock. Torque is transmitted between the mandrel and body by pins which are inserted in cavities formed by grooves on the exterior of the mandrel and the interior of the body. Means are provided to prevent pin rotation and to prevent the pins from contacting the groove edges to provide improved loading and wearing characteristics of the pins.

10 Claims, 6 Drawing Figures

DRILL STRING SHOCK ABSORBER WITH IMPROVED PIN TYPE TORQUE TRANSMISSION MEANS

BACKGROUND OF THE INVENTION

1. Field of the Invention

This invention relates in general to rotary well drilling, and in particular to a shock absorbing apparatus placed in the drill string.

2. Description of the Prior Art

Shock absorbers of various types are used in the drill string of rotary well drilling apparatus. One type uses gas as the shock absorbing medium, as is shown for example in U.S. Pat. Nos. 3,382,936, 3,746,329 and 4,055,338. In each of these patents a fluid filled chamber between a mandrel and a tubular body absorbs vertical shock loading during well drilling operations. To transmit torque while allowing telescoping movement, splines or pins are used between the mandrel and body. Thus, the rotational movement of the drill string is transferred to the drill bit.

In U.S. Pat. No. 3,382,936, splines or ridges extending vertically along the exterior of the mandrel engage grooves on the interior of the body. As shocks are encountered, the splines ride up and down in the grooves while transferring torque from the body to the mandrel. In U.S. Pat. No. 4,055,338, the splines of '936 are replaced by cylindrical pins. These pins are inserted in cavities formed by mating grooves on the interior of the body and exterior of the mandrel. The pins permit sliding or vertical movements of the mandrel relative to the body.

The previous splines or pins used for torque transmission have significant disadvantages. Splines are relatively expensive to machine, particularly if close tolerances are maintained. If loose tolerances are permitted, some splines will be wider than others; some splines will deviate excessively from parallel alignment with the others. As a result, stress and wear will be unequal between the splines and the torque transmission capability will be less than that for which the system was designed.

In the known prior art shock absorbers which use pins as a substitute for milled splines there are also significant disadvantages. The pins are difficult to accurately match with the receiving slots in the mandrel and in the body. This causes some of the pins or splines to experience a greater share of the torque load and stress than others. Sometimes, a single pin or spline must bear the entire load. Correcting this problem by more precise machining is considered prohibitively expensive. Another problem is encountered due to the pin contacting sharp edges along the receiving slots of the body or mandrel. Such edges also create wear problems because of the large resultant contact stresses.

SUMMARY OF THE INVENTION

It is accordingly a general object of this invention to provide an improved shock absorber for use in the drill string of a rotary well drilling apparatus.

It is a further object of this invention to provide a shock absorbing apparatus with improved torque transmission means.

In accordance with these object, a shock absorber is provided of the type having a mandrel reciprocally mounted for rotation with a tubular body and a sealed chamber between the tubular body and the mandrel containing pressurized fluid for absorbing load and shock. Pins are inserted in cavities formed by mating grooves on the exterior of the mandrel and the interior of the body. Means are provided to prevent rotation of the pins within the cavities which allows lapping of the pins and mating grooves to improve load distribution and wearing properties. Means are also provided to prevent the pins from contacting the groove edges which improves the wearing and loading properties of the pins.

DESCRIPTION OF THE PREFERRED EMBODIMENT

Figure 1A:
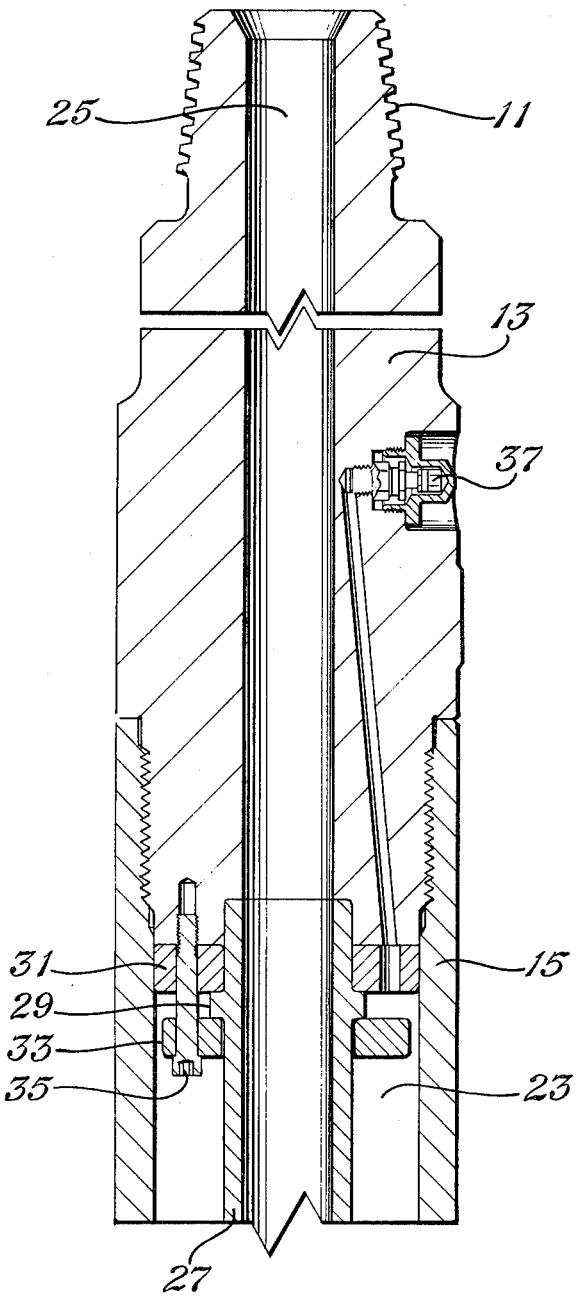
FIG. 1*a* is a longitudinal section of the upper part of a shock absorber constructed in accordance with the principles of this invention.
Figure 1B:
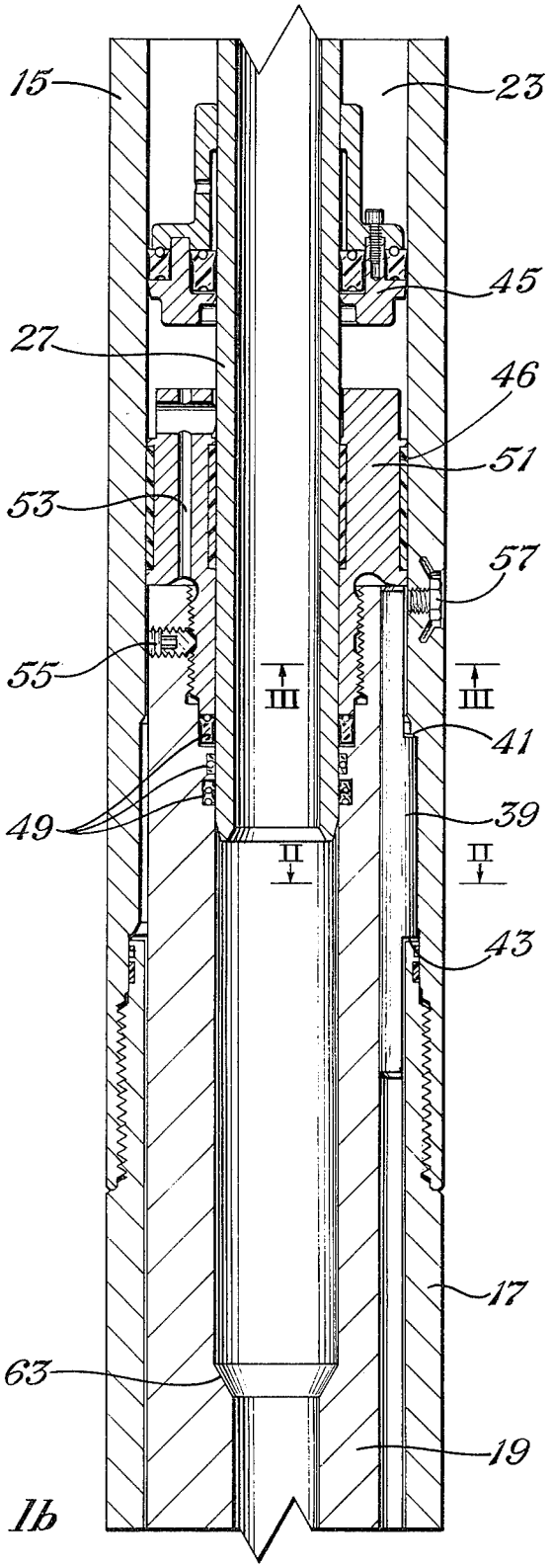
FIG. 1*b* is a longitudinal section of the middle part of the shock absorber.
Figure 1C:
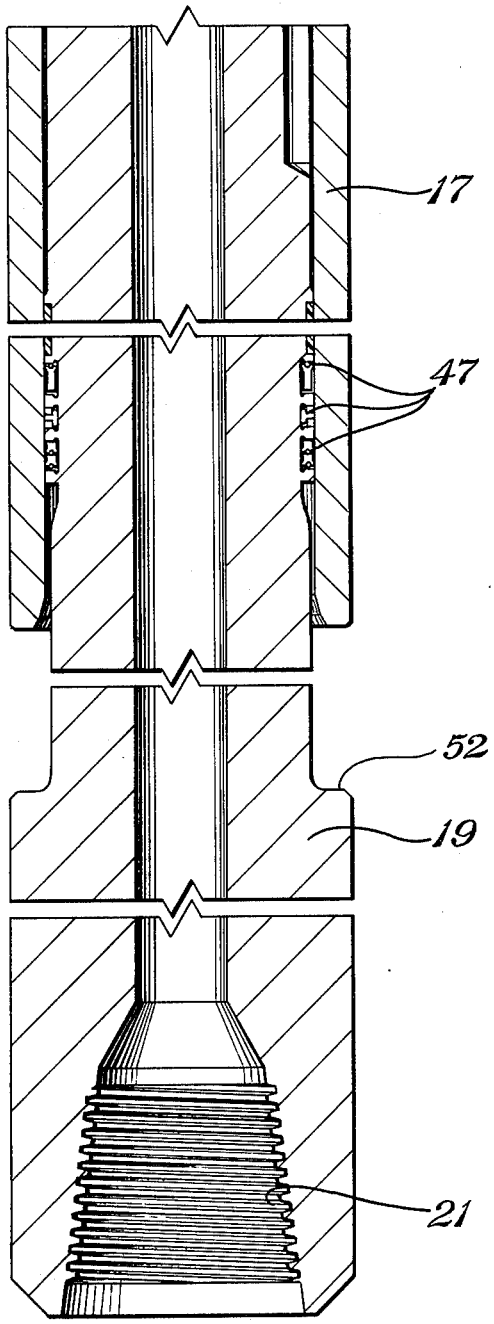
FIG. 1*c* is a longitudinal cross section of the lower part of the shock absorber.

Referring to FIGS. 1*a*, 1*b* and 1*c*, a threaded upper end 11 of the body extends from a top sub 13 for connection to a drill string member (not shown). A cylindrical upper barrel 15 is screwed to the top sub 13, forming a tubular body in cooperation with top sub 13. A cylindrical lower barrel 17 is screwed to the upper barrel 15 extending the length of the tubular body. A mandrel 19 is telescopingly received in the tubular body formed by barrels 15 and 17. Mandrel 19 has a threaded lower end 21 for connection to another drill string member (not shown). A pressurized fluid chamber 23 between the mandrel 19 and top sub 13 supports the load on the drill string and absorbs shock transmitted up the string from the drill bit.

Top sub 13 has an axial passage 25 for transmitting drilling fluid to the drill bit. A tube 27 is mounted to top sub 13 and extends the axial passage 25 through chamber 23. Tube 27 has an annular flange 29 that is held between an upper ring 31 and a lower ring 33 by bolts such as bolt 35. Bolt 35 extends into top sub 13 holding the tube 27 in connection with top sub 13. A charging port and valve means 37 is located in top sub 13 and extends into chamber 23 through upper ring 31 for introducing gas under pressure. The valve may be similar to that shown in U.S. Pat. No. 3,382,936 and functions generally the same as the valve used in a conventional automobile tire.

A plurality of pins, such as pin 39, are inserted in cavities formed by mating grooves on the interior of upper barrel 15 and the exterior of mandrel 19. The pins allow the tubular body to transmit torque to the mandrel 19. Pin 39 is flattened on each end defining two shoulder portions. The upper shoulder portion 41 mates with and engages the upper end of the groove on the interior of upper barrel 15. The lower shoulder portion 43 mates with and engages the upper end of lower barrel 17 which creates a lower end of the groove on the interior of upper barrel 15. In this manner pin 39 is held vertically fixed with respect to the tubular body. The groove on the exterior of mandrel 19, however, extends beyond pin 39 allowing the pin to move up and down with respect to mandrel 19. The grooves and pins will later be described in greater detail.

As explained in more detail in U.S. Pat. No. 4,055,338, all of which material is hereby incorporated by reference, a floating piston type separator 45 is mounted in chamber 23 for dividing the chamber into an upper gas region and a lower liquid region. Mandrel 19 is mounted below piston 45 with its outer diameter in sliding contact through bearing means 46 with the inner diameter of the tubular body formed by barrels 15 and 17. The inner diameter of mandrel 19 is in sliding contact through seal means 49 with the outer diameter of tube 27. Seals 47 engage the mandrel 19 and the lower barrel 17 to seal the liquid region from the exterior. The seals 49 engage mandrel 19 and the tube 27 to seal the liquid region from the circulating drilling fluid region.

A retainer 51, screwed to the top of the mandrel 19, engages upper barrel 15 and tube 27. At its lower travel point, retainer 51 engages the top of pin 39 preventing the mandrel from sliding out of the annular space between the body and the tube 27. A fluid passage port 53 in retainer 51 allows liquid in the liquid region to communicate from the area around pin 39 to the area just below piston 45. A set screw 55 holds the retainer 51 in place on mandrel 19. Ports such as port 57 allow liquid to be introduced into the liquid region and at the same time air to be released as the liquid is introduced.

After assembly of the apparatus, a gas such as nitrogen is introduced into the gas region of chamber 23 through the valve and port 37. The gas is pressurized to a select pressure of, for example, 1,000 psi. A liquid, which may be conventional hydraulic oil, is then introduced through port 57 as air is bled out through another port like 57. Since piston 45 is free to move axially, the pressure in the liquid region and the gas region of chamber 23 will be equalized.

Figure 2:
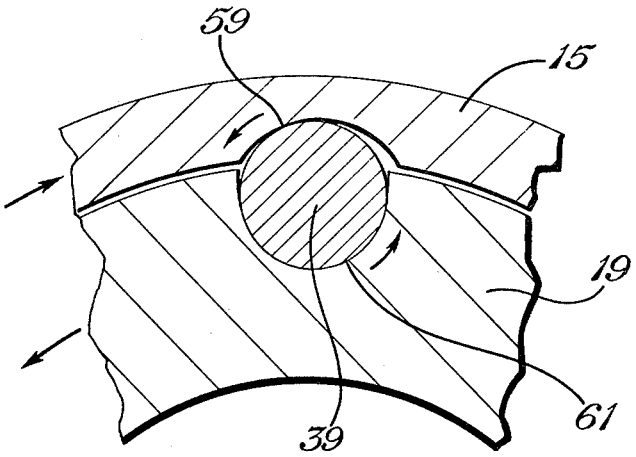
FIG. 2 is a fragmentary cross section of a part of the shock absorber shown in FIG. 1*b*.
Figure 4:
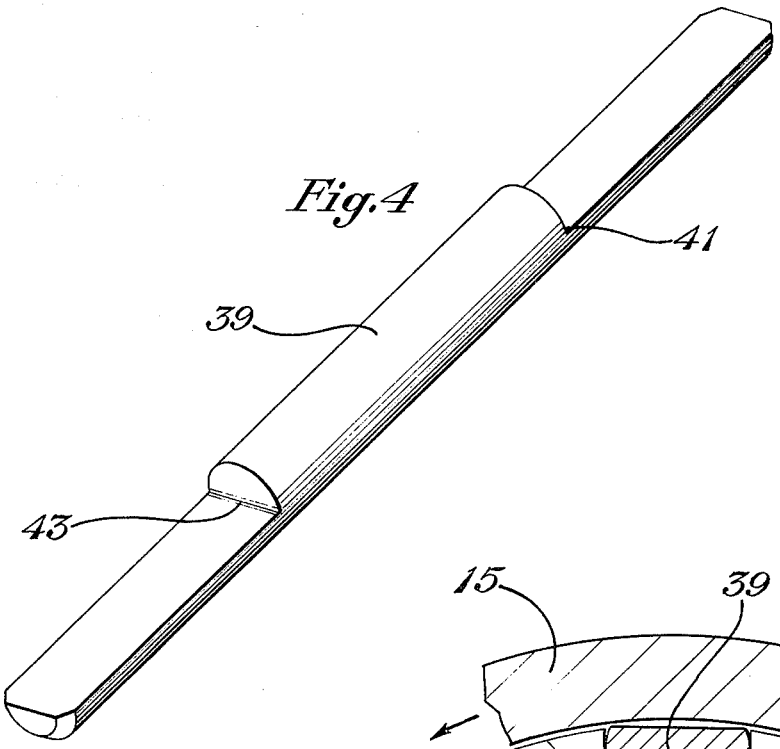
FIG. 4 is a perspective view of a preferred pin.
Figure 3:
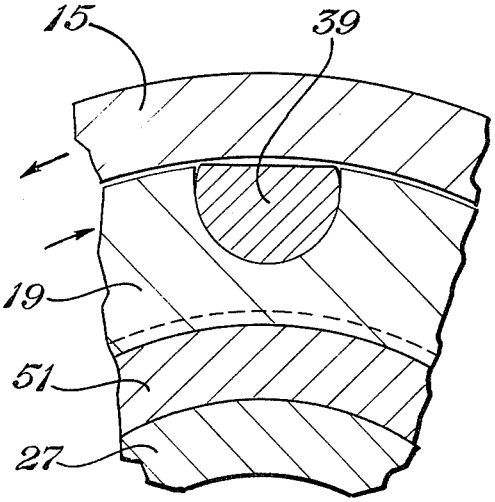
FIG. 3 is a fragmentary cross section of a part of the shock absorber shown in FIG. 1*b*.

Referring now to FIGS. 2, 3 and 4 the transmission of torque between the body and mandrel will be explained in more detail. FIG. 2 shows upper barrel 15 of the body urged clockwise with respect to mandrel 19. Pin 39, however, prevents relative movement of the body and mandrel and allows torque to be transmitted therebetween. If pin 39 were ideally round then there would be a single line of contact between pin 39 and barrel 15 passing through contact point 59. Similarly, there would be a single line of contact between pin 39 and mandrel 19 passing through contact point 61 opposite point 59. In reality, however, the contact is not along lines but along surfaces. These surfaces are where friction occurs as torque is transmitted and shocks are absorbed. Since the pin does not rotate or move vertically with respect to the body, the principal location of wear is on the mandrel side, about point 61.

Point 61 being the major wearing location, it is most important that the magnitude of friction be reduced here. In the prior art, rotation of pins in their cavities and contact of the pins with the groove edges often caused such severe galling and spalling that failure of the pins occurred.

Referring to FIGS. 3 and 4 it can be seen that the flattened portions of the pins prevent rotation of the pins within their cavities since the flattened portions abut the interior of barrels 15 and 17. Preventing the pins from rotating is one way friction is reduced. Since the pins do not rotate, wear occurs uniformly preventing irregularities which could cause galling or spalling of the metal surfaces. Further, nonrotation allows the metal to be cold worked which makes it more durable. Also, since the cold working and wear occurs uniformly, no sudden changes in pin loading occur as might happen if the pins were free to rotate.

Referring now to FIG. 2, it can be seen that pin 39 does not touch the edges of either the mandrel groove or the body groove. This also reduces friction. Herein the term edges means the sharp horizontal limits of a groove. This avoidance of edges is accomplished by two different elements. First, the mandrel groove is deeper (has a greater pin depth) than the body groove. Since the surfaces of contact must be on opposite sides of the pin the shallow body groove forces the mandrel contact surface to be located away from mandrel groove edges. Secondly, the body groove has a larger radius of curvature than the mandrel groove. This creates a point of contact on the body side located away from the body groove edges. The point of contact on the mandrel side must also be located away from the mandrel groove edges since, as stated before, the contact points are on opposite sides of the pin. These two factors, together, reinforce each other to maintain the surfaces of contact away from the groove edges. This reduces friction since edge contact concentrates the area over which friction can occur.

As wear occurs on the grooves and pins, barrel 15 shifts slightly with respect to mandrel 19. Due to the difference in groove radius and depth, this shifting improves the pin loading. When the apparatus is first assembled, some of the grooves are not precisely aligned since perfect machining is not possible. The misalignment causes some of the pins to bear more of the torque load than others. However, since the shifting causes the points of contact to move counterclockwise as shown in FIG. 2, the loading of the pins becomes more nearly equal without causing edge contact or extreme wearing of any of the pins. The loading being more equal, friction on any one pin is reduced.

The pins, that receive loading initially, wear slightly allowing slight relative rotation between barrel and mandrel which allow the remaining pins to also become loaded.

While it is important to prevent edge contact on both the mandrel side and the body side, prevention of edge contact at least on the mandrel side is especially advantageous since vertical sliding occurs here. This is why the mandrel groove is deeper and the body groove has a larger curvature rather than vice versa. If vertical sliding occurs on the body side this situation would be reversed.

In operation, the shock absorber is assembled and fluids are entered into chamber 23 as stated before. The shock absorber is then connected into the drill string. As the drill bit begins to rotate, shocks are encountered which cause mandrel 19 to move upward with respect to the body. The fluid in chamber 23 dampens this shock movement. As the mandrel moves vertically with respect to the body, pin 39 transmits torque therebetween also moving vertically with respect to its groove in the mandrel. The limits of movement between the body and mandrel are defined by the retainer 51 and a shoulder 52 (noted on FIG. 1C) on the lower O.D. of mandrel 19. Retainer 51 encounters pin 39 at the lowermost travel of the mandrel and barrel 17 encounters shoulder 52 at the uppermost travel of the mandrel.

While the invention has been shown in only one of its forms, it should be apparent to those skilled in the art that it is not so limited but is susceptible to various changes and modifications without departing from the spirit thereof.

What is claimed is:

1. In a shock absorbing apparatus for use in a drill string, including a tubular body adapted to be secured to a drill string member; a mandrel reciprocably mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;

b. a plurality of longitudinal grooves on the interior surface of the tubular body mating with the mandrel grooves to form cavities;

c. pins inserted within the cavities for torque transmission; and d. means to prevent rotation of the pins within the cavities to provide improved wearing characteristics of the pins.

2. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body, drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;

b. a plurality of longitudinal grooves on the interior surface of the tubular body mating with the mandrel grooves to form cavities;

c. pins inserted within the cavities for torque transmission, each pin being non-circular in at least one region; and d. the cavity in which each pin is inserted being non-circular in a region which mates with and engages the non-circular region of the pin to prevent rotation of the pin within the cavity to provide improved wearing characteristics of the pins.

3. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;

b. a plurality of longitudinal grooves on the interior surface of the tubular body mating with the mandrel grooves to form cavities;

c. pins inserted within the cavities for torque transmission, each pin being flattened on both ends defining two shoulder portions; and d. each cavity having a selected one of the grooves having shoulder regions which mate with and engage the shoulder portions of the pin such that rotation of the pin within the cavity is prevented and vertical movement of the pin with respect to the selected one of the grooves is prevented.

4. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;

b. a plurality of longitudinal grooves on the interior surface of the tubular body mating with the mandrel grooves to form cavities;

c. pins inserted within the cavities for torque transmission; the pin contacting each groove in at least one location defining two surfaces of contact; and d. means for causing the surfaces of contact to be disposed away from the groove edges to provide improved wear characteristics and more uniform loading of the pins.

5. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;

b. a plurality of longitudinal grooves on the interior surface of the tubular body mating with the mandrel grooves to form cavities;

c. pins inserted within the cavities for torque transmission; the pin contacting each groove in at least one location defining two surfaces of contact;

d. means to prevent vertical movement of each pin with respect to a selected one of the respective grooves defining a sliding groove and a non-sliding groove for each cavity; and e. means for causing the surface of contact of each pin to be disposed away from the sliding groove edges to provide improved wear characteristics and more uniform loading of the pins.

6. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;
b. a plurality of longitudinal grooves on the interior surface of the tubular body mating with the mandrel grooves to form cavities;
c. pins inserted within the cavities for torque transmission; the pin contacting each groove in at least one location defining two surfaces of contact; and
d. the curvature of one of the grooves being greater than the other for causing the surfaces of contact to be disposed away from the groove edges to provide improved wear characteristics and more uniform loading of the pins.

7. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;
b. a plurality of longitudinal grooves on the interior surface of the tubular body mating with the mandrel grooves to form cavities;
c. pins inserted within the cavities for torque transmission; the pin contacting each groove in at least one location defining two surfaces of contact; and
d. one of the grooves having a greater pin depth than the other for causing at least one of the surfaces of contact to be disposed away from the groove edges to provide improved wear characteristics and more uniform loading of the pins.

8. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;
b. a plurality of longitudinal grooves on the interior surface of the tubular body mating with the mandrel grooves to form cavities;
c. pins inserted within the cavities for torque transmission; the pin contacting each groove in at least one location defining two surfaces of contact; and
d. the curvature of one of the grooves being greater than the other, the one with the greater curvature having a smaller pin depth; the difference in curvature and pin depth causing the surfaces of contact to be disposed away from the groove edges to provide improved wear characteristics and more uniform loading of the pins.

9. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;
b. a plurality of longitudinal grooves on the interior surface of the tubular body mating with the mandrel grooves to form cavities;
c. pins inserted within the cavities for torque transmission; the pin contacting each groove in at least one location defining two surfaces of contact;
d. means to prevent rotation of the pins within the cavities to provide improved wearing characteristics of the pins; and
e. means for causing the surfaces of contact to be disposed away from the groove edges to provide improved wear characteristics and more uniform loading of the pins.

10. In a shock absorbing apparatus for use in a drill string, including a tubular body adapted to be secured to a drilling string member; a mandrel reciprocally mounted to the tubular body for rotation therewith and having a portion adapted to be secured to another drill string member, the mandrel being shaped such that it sealingly engages the body; drilling fluid passage means within the tubular body and the mandrel for passage of drilling fluid; and a sealed chamber between the tubular body and the mandrel, containing pressurized fluid for absorbing load and shock; the improvement which comprises:

a. a plurality of longitudinal grooves on the exterior surface of the mandrel;
b. a plurality of longitudinal grooves on the interior surface of the tubular body mating with the mandrel grooves to form cavities;
c. pins inserted within the cavities for torque transmission; each pin contacting each of their respective grooves in at least one location defining two surfaces of contact, each pin being flattened on both ends defining two shoulder portions;
d. each cavity having a selected one of the grooves having shoulder regions which mate with and engage the shoulder portions of the pin such that rotation of the pin within the cavity is prevented and vertical movement of the pin with respect to the selected one of the grooves is prevented; and
e. the curvature of the selected one of the grooves being greater than the curvature of the non-selected groove, the selected one of the grooves having a smaller pin depth, the difference in curvature and pin depth causing the surface of contact of the non-selected groove to be disposed away from edges of the non-selected groove to provide improved wear characteristics and more uniform loading of the pins.

* * * * *